US008561669B2

(12) United States Patent
Næss, Jr. et al.

(10) Patent No.: US 8,561,669 B2
(45) Date of Patent: Oct. 22, 2013

(54) CASTING EQUIPMENT FOR THE CASTING OF SHEET INGOT

(75) Inventors: Harald Næss, Jr., Grøa (NO); Terje Iveland, Sunndalsøra (NO); Arild Håkonsen, Sunndalsøra (NO); Tore Strandheim, Sunndalsøra (NO); Ulf Bersås, Sunndalsøra (NO)

(73) Assignee: Norsk Hydro ASA, Oslo (NO)

( * ) Notice: Subject to any disclaimer, the term of this patent is extended or adjusted under 35 U.S.C. 154(b) by 0 days.

(21) Appl. No.: 13/128,291

(22) PCT Filed: Sep. 7, 2009

(86) PCT No.: PCT/NO2009/000309

§ 371 (c)(1),
(2), (4) Date: Jul. 29, 2011

(87) PCT Pub. No.: WO2010/059058

PCT Pub. Date: May 27, 2010

(65) Prior Publication Data

US 2011/0315339 A1 Dec. 29, 2011

(30) Foreign Application Priority Data

Nov. 21, 2008 (NO) ..... 20084917

(51) Int. Cl.
*B22D 11/05* (2006.01)

(52) U.S. Cl.
USPC ..... 164/436; 164/491

(58) Field of Classification Search
USPC ..... 164/435–436, 491, 424
See application file for complete search history.

(56) References Cited

U.S. PATENT DOCUMENTS

| | | | | |
|---|---|---|---|---|
| 4,030,536 | A | 6/1977 | Rodenchuk et al. | |
| 4,660,615 | A * | 4/1987 | Lemper | 164/418 |
| 4,669,526 | A | 6/1987 | Hury | |
| 5,931,216 | A | 8/1999 | Carrupt et al. | |
| 5,947,184 | A | 9/1999 | Steen et al. | |

FOREIGN PATENT DOCUMENTS

| | | |
|---|---|---|
| EP | 0 796 683 | 3/1997 |

OTHER PUBLICATIONS

International Search Report issued Feb. 12, 2010 in International (PCT) Application No. PCT/NO2009/000309.

* cited by examiner

*Primary Examiner* — Kevin P Kerns
(74) *Attorney, Agent, or Firm* — Wenderoth, Lind & Ponack, LLP

(57) ABSTRACT

Equipment for the semi-continuous direct chill (DC) casting of sheet ingot or slabs of different dimensions, in particular for rolling purposes, including a mold frame (2) with a pair of facing long side walls (3) and a pair of facing short end walls (4). The walls of the mold define an upwardly open inlet for the supply of metal and a downwardly facing outlet provided with a starter block (5) on a movable support which prior to each casting closes the opening. The equipment includes a device for changing the mold dimensions where at least one end wall can be displaced to enable casting of ingots with different sizes, and it further includes a device for indirect and direct cooling of the metal during casting. The equipment also includes apparatus for flexing the long side walls (3) of the mold, thereby enabling adjustment of the flexible middle part of the long side walls (3) inwardly or outwardly to adapt to the desired sheet ingot size, the desired casting speed and/or alloy composition.

10 Claims, 8 Drawing Sheets

CASTING EQUIPMENT FOR THE CASTING OF SHEET INGOT

BACKGROUND OF THE INVENTION

1. Technical Field

The present invention relates to equipment for the semi-continuous direct chill (DC) casting of sheet ingot or slabs of different dimensions, in particular ingot or slabs for rolling thin sheet, including a mold frame with a pair of facing side walls and a pair of facing end walls, the walls defining a mold with an upwardly open inlet for the supply of metal and a downwardly facing outlet provided with a starter block on a movable support which prior to each casting closes the downwardly facing opening and where at least one side wall and/or one end wall can be displaced to enable casting of ingots with different dimensions, the equipment further including means for cooling the metal.

2. Description of the Related Art

When casting large rectangular-section ingots to be used in the production of rolled products It is customary to impart a small amount of convex curvature to the long side walls of the mold to counteract the greater metal shrinkage (pull-in) which takes place near the middle of the wide side faces of the ingot during solidification as compared with locations near the narrow end faces of the ingot. The shrinkage (pull-in) of the metal is proportional to the extension of the non-frozen metal in the ingot after casting conditions are stabilized. During the casting of large ingots, the extension of melted metal in the lengthways direction of the ingot (the sump depth) may be up to 0.8 meter or more depending on the size of the ingot.

It is primarily the casting speed that influences the extension of the marsh, because it is the thermal conductivity of the material that limits the cooling speed in the middle of the ingot. The amount of water that is jetted onto the ingot surface on the underside of the mold represents a cooling capacity that goes beyond the amount of heat that is transferred to the surface by heat conduction.

With regard to both metallurgy and productivity it is desirable to apply the highest casting speed possible. The casting speed is normally limited by the tendency of heat crack formation in the ingot being cast when the speed is too high.

In the initial stage of a casting operation, the cooling will be slow and there will be a contraction in the ingot being cast caused by the difference in specific density between the melted and the frozen metal, together with the thermal coefficient of expansion. The metal, that initially has frozen, will be of somewhat reduced shape in relation to the geometry of the casting mold. Because of the above-mentioned curvature of the widest faces of the casting mold, the ingot being cast will assume a convex shape in the initial stage of the casting operation. The convexity will gradually reduce until stable conditions with respect to the sump depth in the ingot being cast are stabilized.

The operating manual of a rolling mill specifies that the rolling surfaces should be straight (without any concavity or convexity in the rolling surfaces). To meet this requirement the casting molds have to be designed with a curvature (flexing) of the side walls corresponding to the estimated shrinkage/contraction of the ingot to be cast.

The applicants own EP 0 796 683 B1 relates to equipment for the casting of sheet ingot of the above kind where the side walls that are adapted for flexing and are further provided with a stiffening part at their middle region to obtain controlled stiffness and thereby optimal flexure of the mold walls versus the casting speed. This known solution is, however, not designed for casting ingots with different dimensions (size).

When continuously casting ingots or slabs for rolling purposes, which are in the form of large metal blocks with rectangular cross sections, it is normal to employ a special mold for each ingot width and thickness. Mainly because of the close dimensional tolerances required, it is complicated and expensive to produce continuous casting molds. As many different ingot formats are required, it is necessary but uneconomical to keep a corresponding large number of molds in store. Besides, replacing a mold of one dimension with another mold with different dimension is demanding and time consuming.

U.S. Pat. No. 5,931,216 relates to adjustable continuous casting molds for manufacturing continuously cast ingots of different dimensions where the object is to provide an adjustable mold which provides rapid change to the required ingot cross section based on the one and same mold. An important disadvantage with this solution is that the shape of the mold has no means to compensate for casting speed or change of dimension of the mold having in turn bad effect on ingot geometry.

BRIEF SUMMARY OF THE INVENTION

The present invention provides a mold where the disadvantages with the above known solutions are avoided, i.e. where the walls of the mold can be easily adjusted from one dimension to another casting sheet ingots with different dimensions and where at the same time flexing of the walls is possible to compensate for different speed as well as dimension and alloy composition.

BRIEF DESCRIPTION OF THE DRAWINGS

The present invention will be described in further detail in the following by means of examples and with reference to the drawings, where.

DETAILED DESCRIPTION OF THE INVENTION

Prior to the development of the present invention it was agreed that certain minimum requirements should be defined with regard to the design and performance of the sheet ingot casting equipment:

the new technical solution shall not increase the danger of explosions or worsen the HES situation of the cast house, the maximum dimension deviation on the cast ingot shall be within ±2 mm from 150 mm casting, casting speed may be changed still keeping the dimension deviation within the above-mentioned limits, changing the dimension of the ingot shall not represent extra work compared to change of dimension with conventional equipment using different molds with different dimensions, the mold shall have continuous water jet cooling down to 4 $m^3$/h/m water amount (recommended start water amount).

no leakage of water to the mold cavity should be possible,

The design criteria and above requirements directed the inventors to a mold technology solution for sheet ingot which combines both flexing and dimension adjustments of the same mold. The flexible mold principle was invented to obtain the requirements on geometry, while at the same time the adjustable mold principle was chosen to reduce the cost of casting each dimension.

The most common dimensions for sheet ingot for rolling are based on 600 mm standard thickness with varying width from 1550-1850 mm and with 50 mm steps. Other dimensions may also occur such as 1950-2200 mm and with 50 mm steps.

Figure 1:
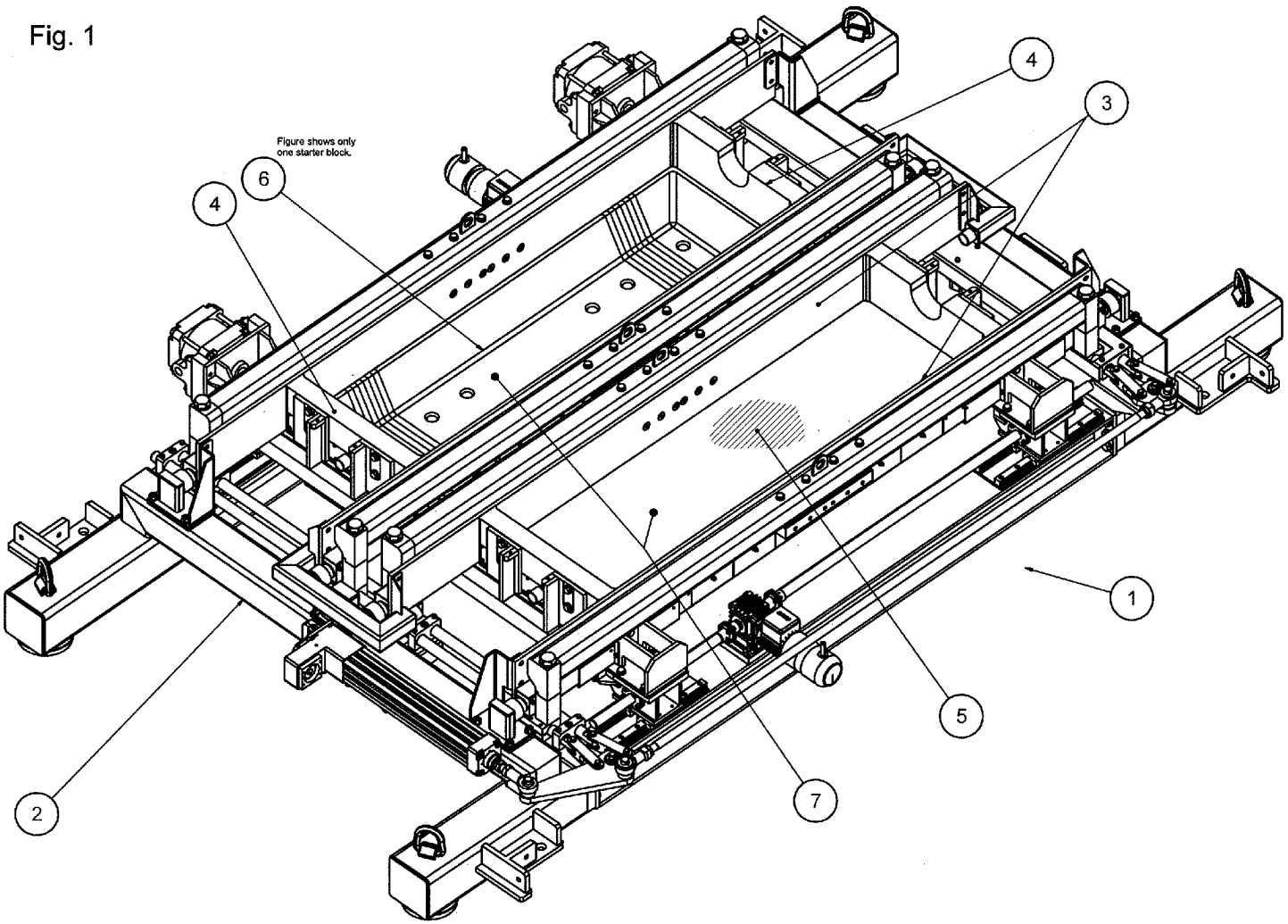
FIG. 1 shows in perspective, partly from above and in the longitudinal direction, a schematic view of the casting equipment according to the present invention.
Figure 2:
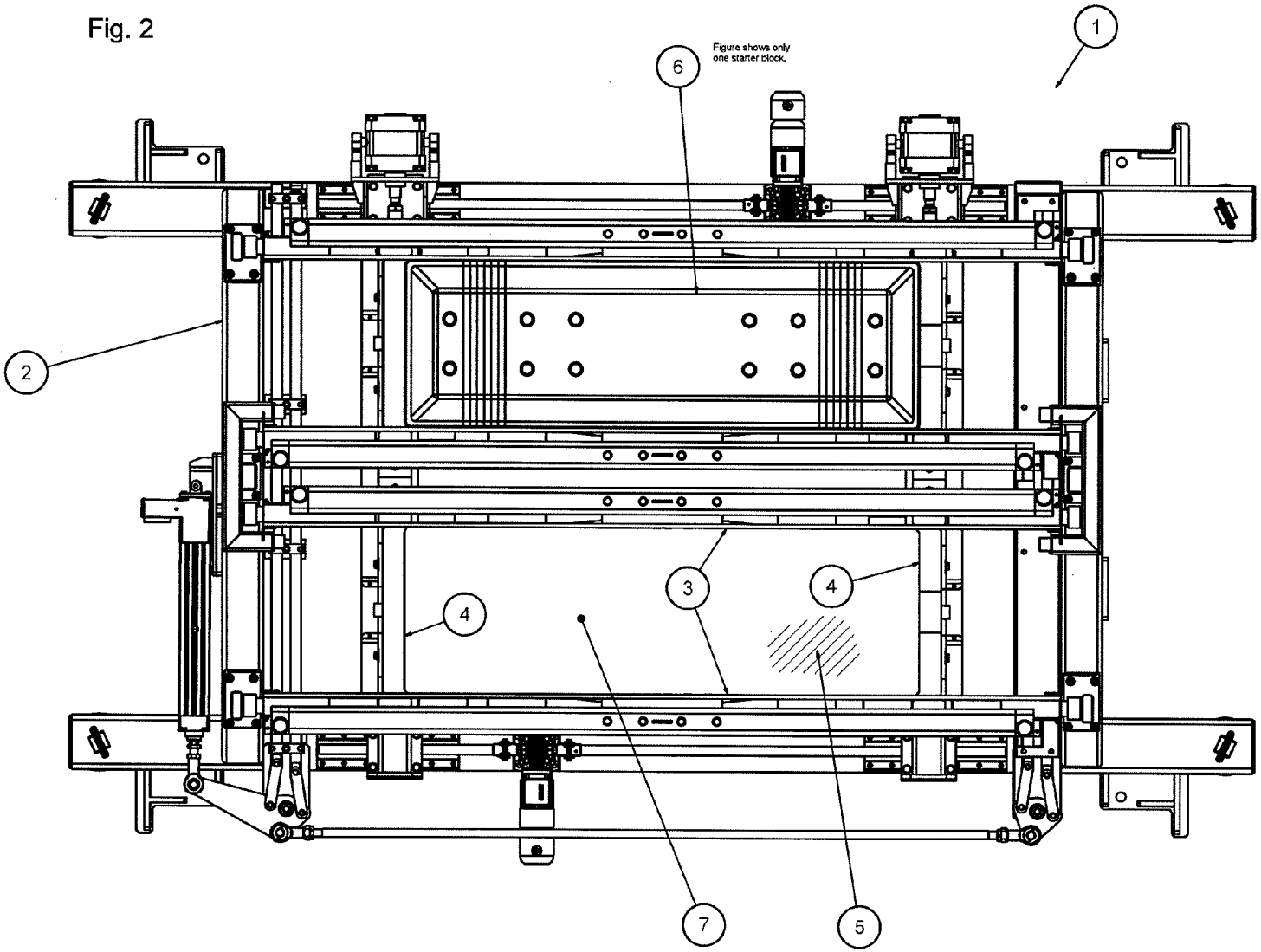
FIG. 2 shows a horizontal view of the equipment shown in FIG. 1.

FIGS. 1 and 2 shows, as stated above, equipment 1 for the semi-continuous direct chill (DC) casting of sheet ingot or slabs of different dimensions, in particular for rolling, requiring large ingots with rectangular cross section of the above-mentioned kind. The equipment as shown in FIGS. 1 and 2 comprises two molds 7 provided in parallel in a mold frame 2, each mold 7 including a pair of facing side walls 3 and a pair of facing end walls 4. The walls defines a mold cavity 5 with an upwardly open inlet for the supply of metal and a downwardly facing outlet provided with a starter block 6 connected to a movable support (not shown in the figures) and which prior to each casting sequence closes the downwardly facing opening. The equipment further includes means for cooling the metal comprising supply means for water and water jet nozzles 8 arranged in the lower part of the walls 3, 4 along the periphery of the mold 7 (not further shown).

The unique and inventive features of the present invention are the combination of means for adjusting one or more of the short end walls of the mold frame with means to provide flexing of the long side walls facing the mold cavity to enable casting of sheet ingots with different dimensions.

Figure 3:
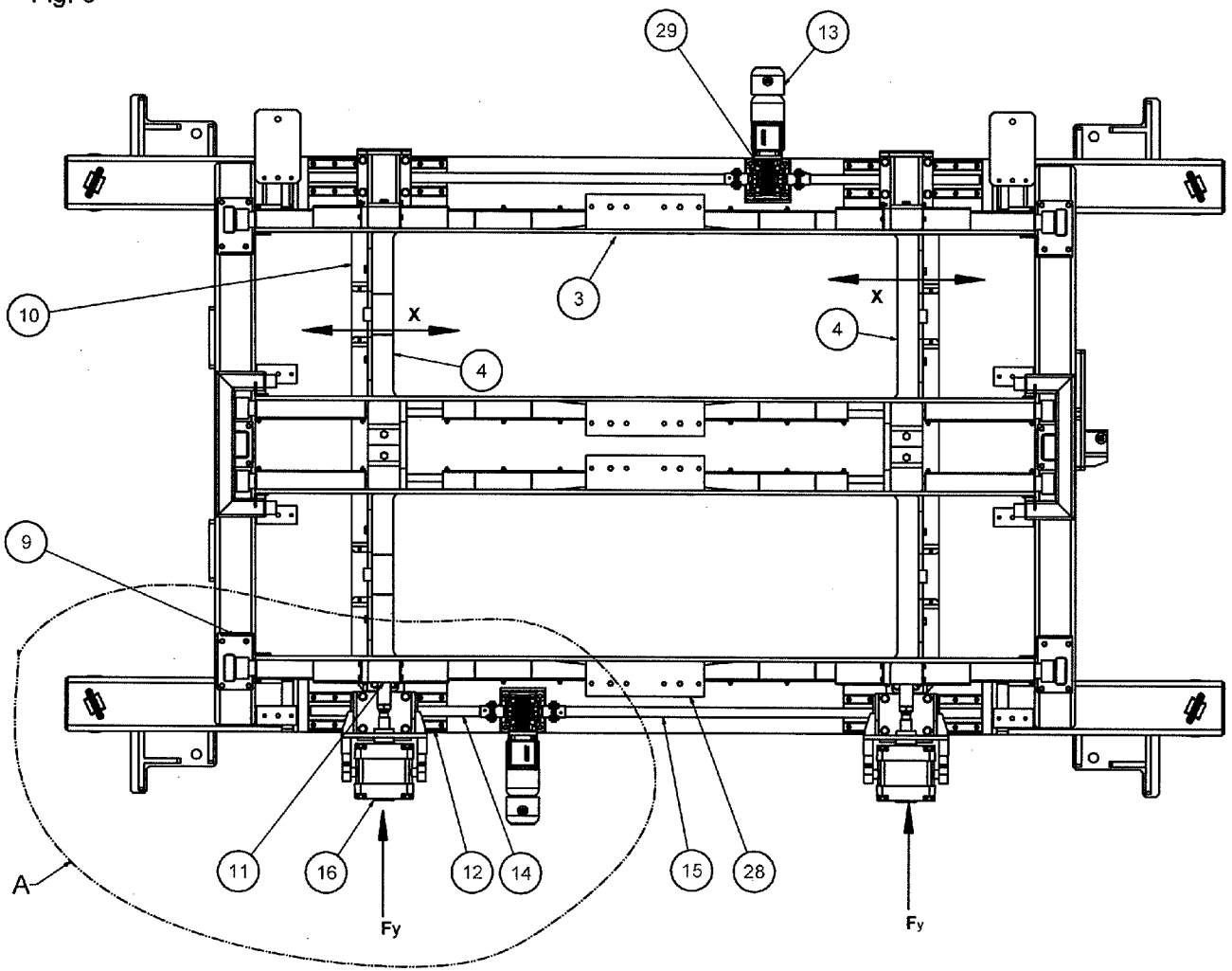
FIG. 3 shows a horizontal view of the equipment shown in FIGS. 1 and 2, including the mechanism for adjusting the mold of the casting equipment, but excluding the mechanism for flexing the molds.
Figure 4:
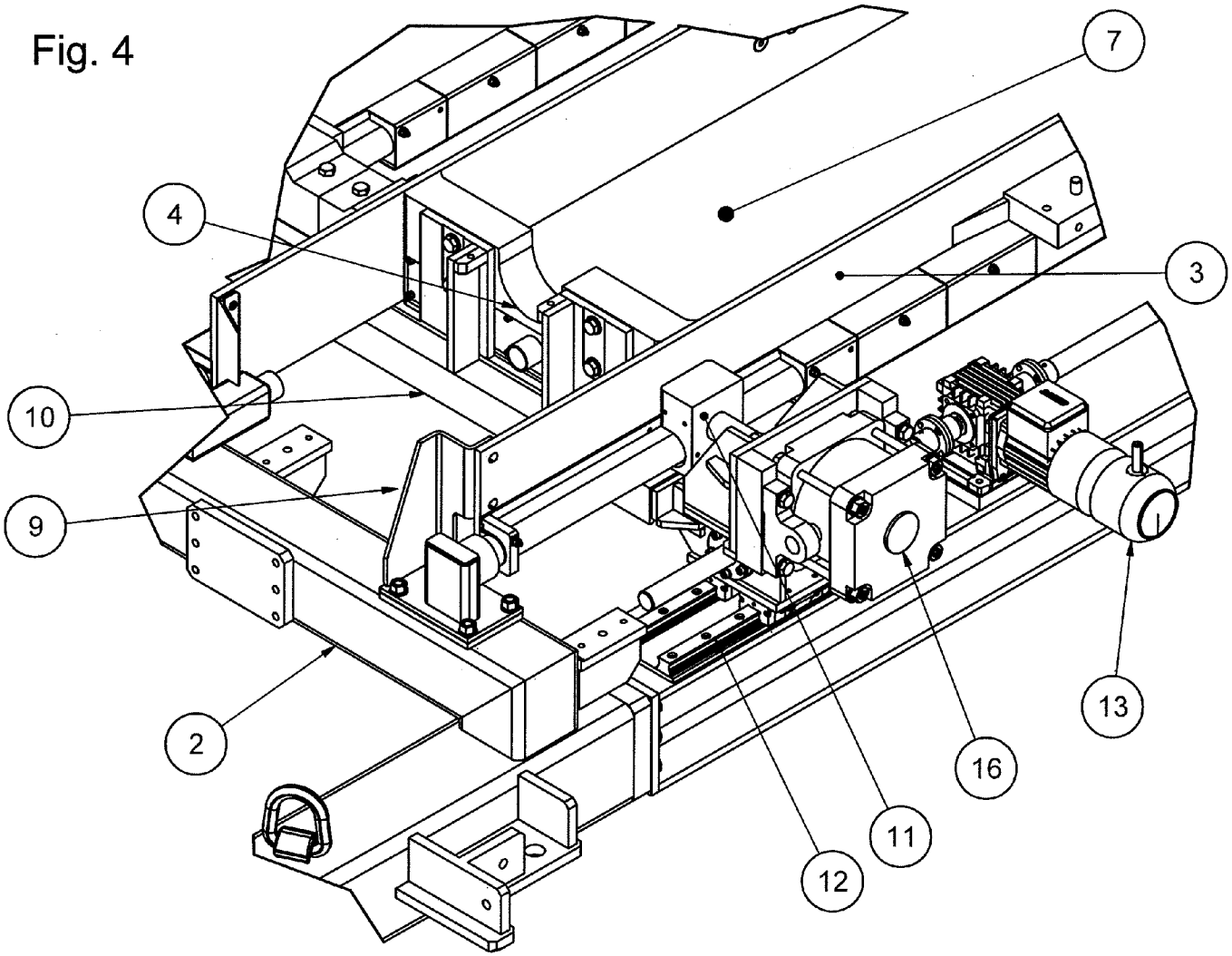
FIG. 4 shows in larger scale and in perspective part of the equipment denoted A in FIG. 3.

FIG. 3 shows a horizontal view (from above) and FIG. 4 part (denoted A in FIG. 3) of the equipment shown in FIGS. 1 and 2 with a mechanism for adjusting the end walls to adjust the size of the mold cavity 5 and thereby the size of the cast ingot (the mechanism for flexing is excluded from this figure) . Each of the long side walls 3 are releasable fixed to the frame 2 at each end via brackets 9, while the short end walls 4 are provided on a movable beam 10 connected at each end to a holder 11 which is movably provided along a guide rail 12 on the frame 2. The beams 10 with the short end walls 4 may be adjusted (moved in direction x as denoted in the figure) by means of electric motors 13 provided on each side of the mold via a gear 29 (not further shown) with worm screw driving means 14, 15. The motors 13 may preferably be controlled by a computer, and the short end walls 4 thereby adjusted, in accordance with a preset dimension scheme with (such as) 50 mm dimension steps as indicated above, or be freely operated to a desired dimension. After being adjusted to the desired dimension, the short end walls are held in position between the long side walls 3 by means of a securing arrangement 16 provided on the movable beam 10. The securing arrangement 16 may be a mechanical device or piston/cylinder device, preferably a pneumatic jack device 16 as shown in FIG. 4 pressing with a pre set force against the long side walls 3 from the outside in direction of the arrow $F_y$ as shown in the figure.

Figure 5:
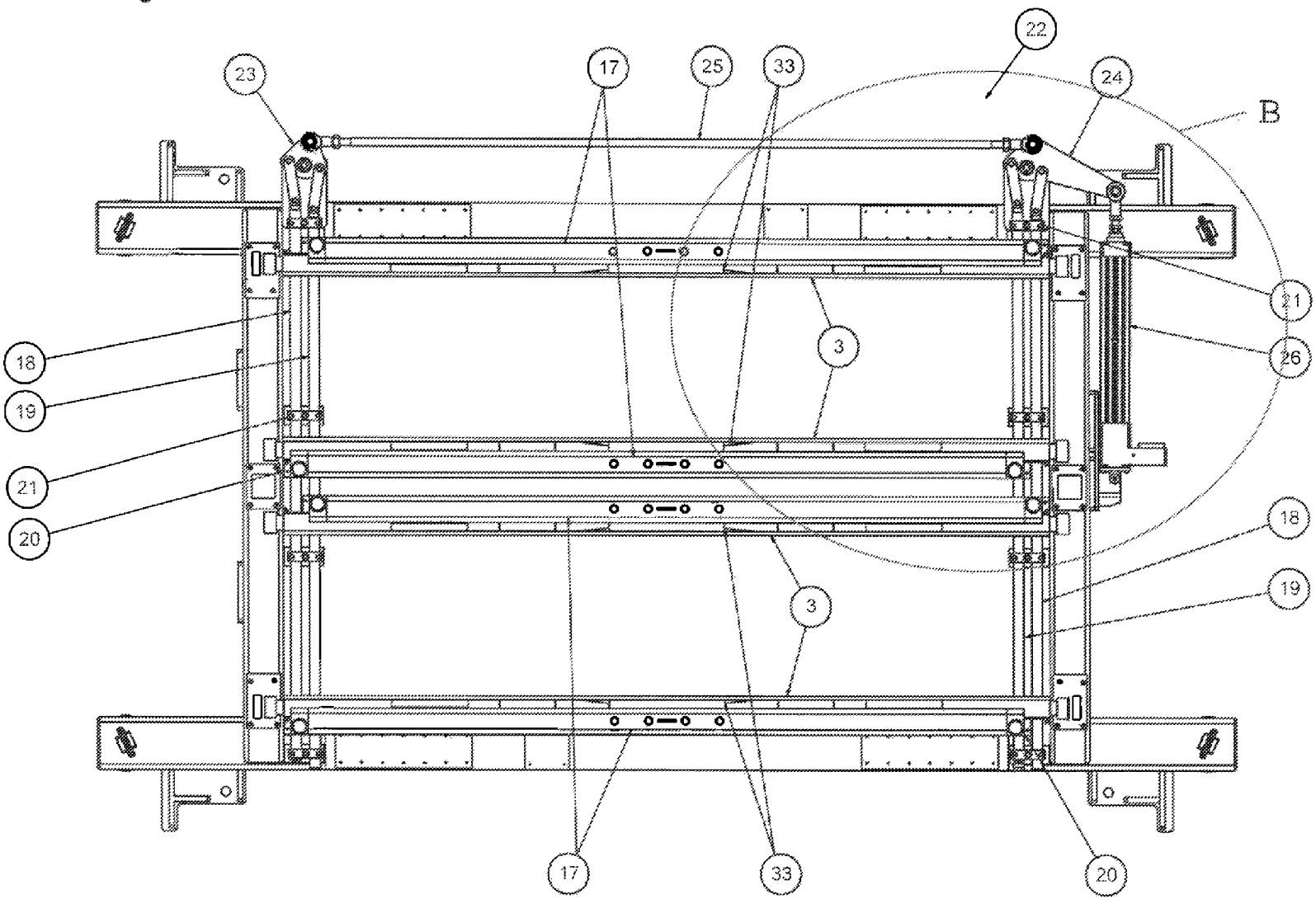
FIG. 5 shows a horizontal view of the equipment shown in FIGS. 1 and 2, including the mechanism for flexing the mold, but excluding the mechanism for adjusting the mold of the casting equipment.
Figure 6:
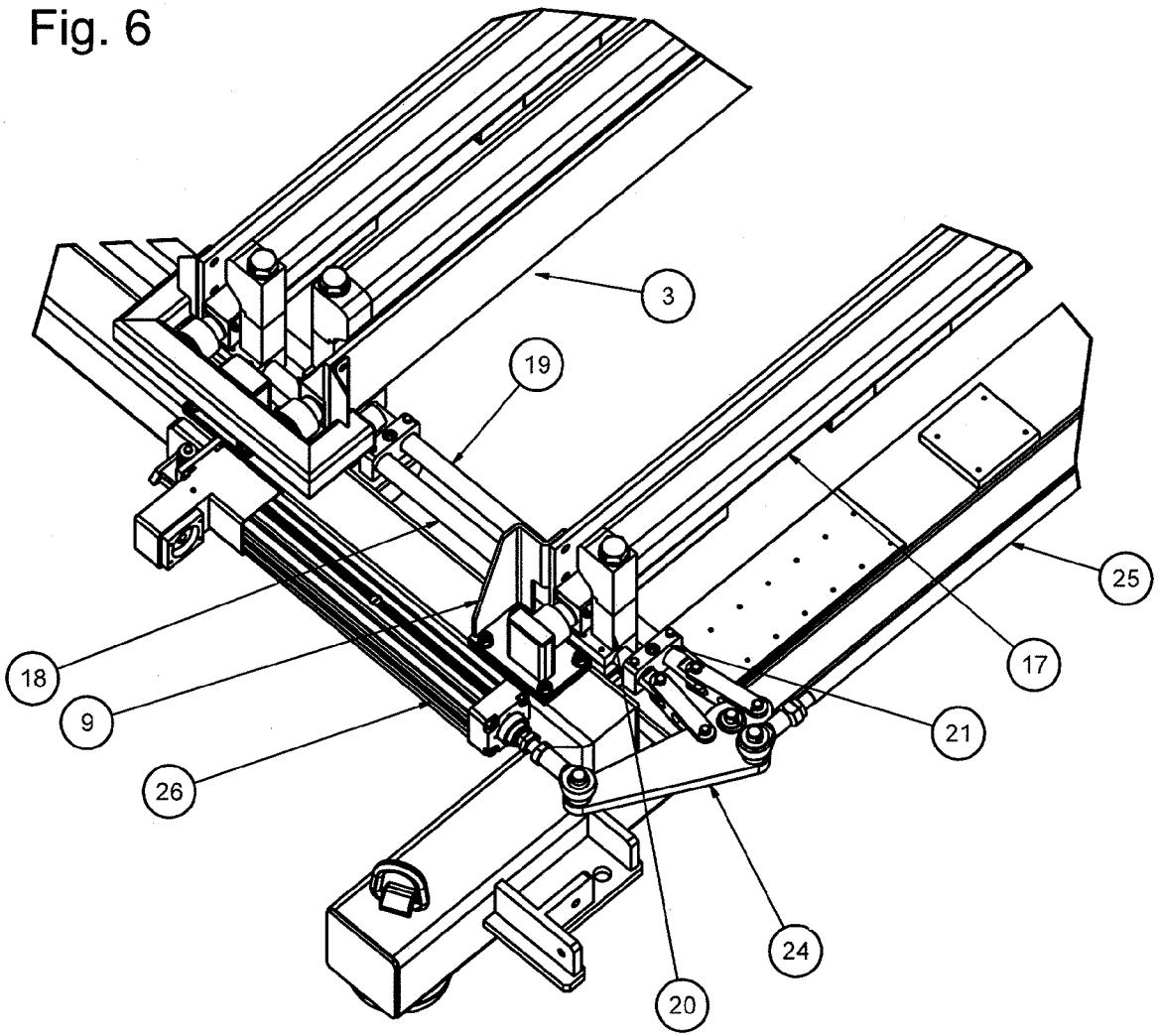
FIG. 6 shows in larger scale and in perspective part of the equipment denoted B in FIG. 5.

FIG. 5 shows a horizontal view of the equipment shown in FIGS. 1 and 2, including the mechanism (means) for flexing the molds, but for clarity reason excluding the mechanism (means) for adjusting the size of the mold of the casting equipment as shown in FIG. 3. FIG. 6 shows in larger scale and in perspective part of the equipment denoted B in FIG. 5

Each of the long side walls 3 for each mold 7 are at their respective ends as stated above fixed to the frame 2 by means of brackets 9, but at their middle part attached to adjusting beams 17 arranged in parallel with said side walls 3. The long side walls 3 are attached to the beams via an adjustable stiffening arrangement 33 (further explained below). The adjusting beams 17 are of greater length than the long side walls 3 and are each at their respective ends connected to pull/push bars 18, 19 via connectors in the form of friction grip clamping devices or the like 20 (not further shown). The pull/push bars are provided in parallel with the short end walls and are adapted for axial movement through holders 21 with slide bearings (not shown as such) by means of an actuating mechanism 22. The actuating mechanism includes two lever arms, one 23 rotatably provided on the left hand side of the frame 2 (as shown in the figure) and another 24 rotatably provided on the right hand side of the frame and being linked to one another through a link arm 25, and an actuator such as a cylinder/piston device 26 connected with the lever arm 24 provided to rotate the lever arm 24 as well as the lever arm 23 via the link arm 25.

The lever arm 24 is directly connected to the actuator 26 via a link 27 and the flexing of the long side walls 3 of the mold is obtained by moving the adjusting beams 17 outwardly from or inwardly towards the center of the mold 7 by means of the actuator through axial movement of the pull/push bars 18, 19, 25 via the lever arms 23, 24 respectively. The flexible middle part of the long side walls 3 are thereby adjusted inwardly or outwardly to adapt to the desired sheet ingot. The transmission ratio of the actuating mechanism and thereby the flexing of the side walls, is defined by the length of the arms of the levers 23, 24.

As stated above the actuator 26 may suitably be in the form of hydraulic piston/cylinder device with an internal piston sensor, where the piston may be controlled by means of a PLC (Programmable Logic Control) via a servo valve (or proportional valve) on the basis of a predetermined pattern of flexing depending on the dimension of the sheet ingot to be cast, the alloy composition and the casting speed.

Figure 7:
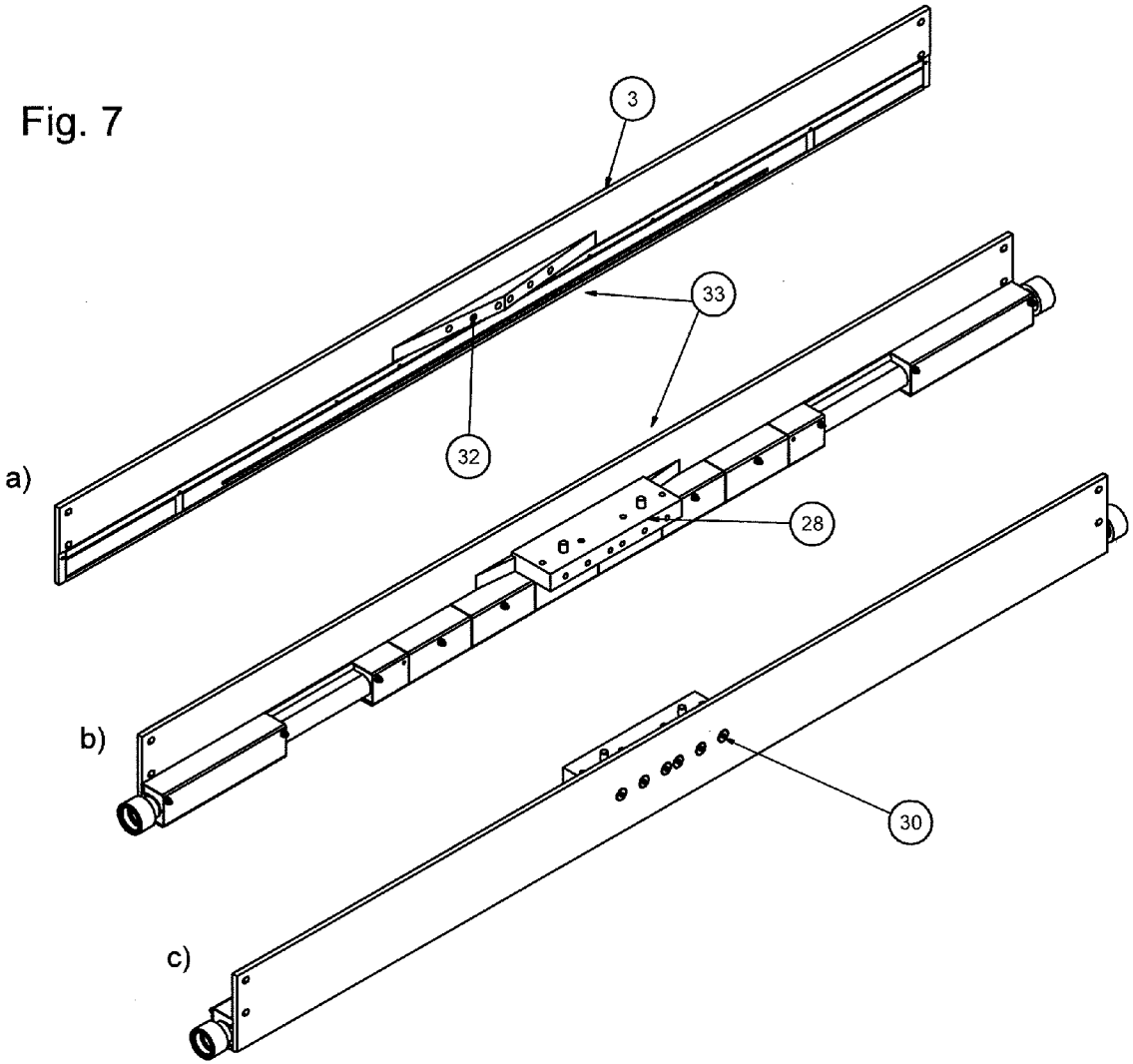
FIG. 7 shows in different views a), b), c) the long side wall as such in perspective with a stiffening arrangement according to the invention.
Figure 8:
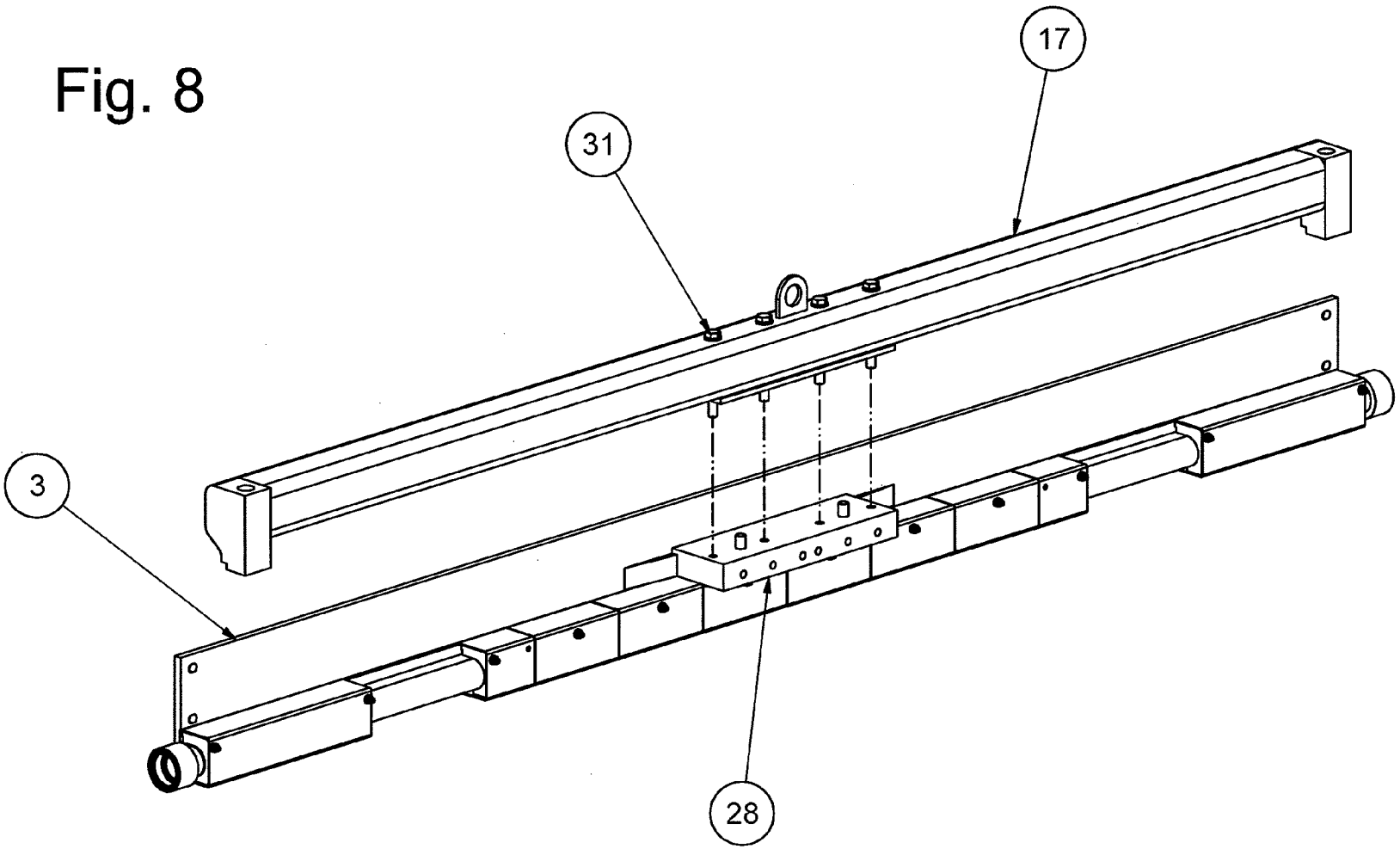
FIG. 8 shows the same as in FIG. 7, but including an adjusting beam according to the invention.

The stiffening arrangement 33 in conjunction with the flexing long side walls 3 represents an important feature of the invention and enables adjustment of the stiffness of the middle part of the long side walls in relation to the size of the dimension of the ingot to be cast. Thus, if the dimension of the ingot is increased, the stiffness of the middle part of the long wall needs to be increased over a larger part of the wall as well. The stiffness is calculated on the basis of suitable algorithm which is not further explained herein. The stiffening arrangement 33 as such (design) is, however, further shown in details in FIGS. 7 and 8. Hence, FIG. 7 a) shows the flexible long side wall 3 with an integrated stiffening part 32. The stiffening part 32 stretches over a length of the middle part of the long side wall 3 on the outside of the wall (relative to the mold cavity) and has an elevated shape from its ends towards the middle (triangular shape). As is shown in FIG. 7 *b*), a stiffening intermediate plate 28 is adapted to fit with the stiffening part 32 and is connected to the long side wall and stiffening part 32, as further shown in FIGS. 7*c*) and FIG. 8, by means of through going bolts 30. FIG. 8 shows in addition the long side wall 3 and stiffening arrangement 33 the adjusting beam 17 (described above) and which in turn is connected to the stiffening plate 28 by means of connecting bolts 31. The stiffness of the middle part of the long side walls can be increased or reduced by means of the bolts 30. If the two middle bolts are used, the stiffness is reduced. On the other hand if the outer bolts, one on each side, are used the stiffness increases over a larger length of the middle part of the long sides 3.

The invention claimed is:

1. Equipment for the semi-continuous direct chill (DC) casting of sheet ingot or slabs of different dimensions, in particular for rolling purposes, including a mold frame having a pair of facing long side walls and a pair of facing short end walls, the walls defining an upwardly open inlet for the supply of metal and a downwardly facing outlet provided with a starter block provided on a movable support, which prior to each casting, closes the opening and including means for changing the mold dimensions where at least one of the short end walls can be displaced to enable casting of ingots with different sizes, the equipment further including means for indirect and direct cooling of the metal during casting, wherein:

the equipment, in addition to the means for changing the mold dimensions, includes means for flexing the long side walls of the mold, thereby enabling adjustment of a flexible middle part of the long side walls inwardly or outwardly to adapt to a desired sheet ingot size, a desired casting speed and/or alloy composition.

2. The equipment according to claim 1, wherein the short end walls are each movably provided between the long side walls on a beam.

3. The equipment according to claim 1, wherein each beam is movably provided on the frame along a guide by means of a drive arrangement.

4. The equipment according to claim 1, wherein the short end walls for each mold dimension during casting are held in position between the long side walls by a securing arrangement.

5. The equipment according to claim 1, wherein the securing arrangement is a piston/cylinder device adapted to press against the long side walls from the outside and towards the ends of the short end walls.

6. The equipment according to claim 1, wherein the securing arrangement is provided on one of the beams and is movable with the one beam.

7. The equipment according to claim 1, wherein a stiffening arrangement is provided in conjunction with the flexing long side walls enabling adjustment of the stiffness of the middle part of the long side walls in relation to the size of the dimension of the ingot to be cast.

8. The equipment according to claim 1, wherein the securing arrangement is a pneumatic piston/cylinder device adapted to press against the long side walls from the outside and towards the ends of the short end walls.

9. Equipment for the semi-continuous direct chill casting of sheet ingot or slabs of different dimensions, the equipment comprising:

a mold frame having a pair of facing long side walls and a pair of facing short end walls defining a mold cavity having an upwardly open inlet for the supply of metal and a downwardly facing outlet;

a starter block, which prior to each casting, closes the opening;

a mechanism for adjusting the mold dimensions by adjusting the positions of the short end walls, the mechanism including movable beams connected the short end walls and to a guide rail supported on the frame, and motors operably connected to the movable beams on opposite sides of the mold;

a pressing device for applying a pressing force against the long side walls, thereby securing the short end walls in a desired position between the long side walls; and adjusting beams attached to middle portions of the long side walls, respectively, wherein the long side walls are attached to the adjusting beams via an adjustable stiffening arrangement, and flexing of the long side walls is obtained by moving the adjusting beams toward or away from a center of the mold, thereby enabling adjustment of a flexible middle part of the long side walls inwardly or outwardly to adapt to a desired sheet ingot size, a desired casting speed and/or alloy composition.

10. The equipment according to claim 9, wherein the stiffening arrangement includes stiffening parts extending over a length of the middle portion of the long side walls, and stiffening intermediate plates connected to the long side walls and the stiffening parts, respectively, and wherein the stiffening intermediate plates are also connected to the adjusting beams, respectively.

* * * * *